US005902092A

United States Patent [19]

Erlandson et al.

[11] Patent Number: 5,902,092

[45] Date of Patent: May 11, 1999

[54] SELF-CLEARING TRANSFER ARMS

[75] Inventors: Greg E. Erlandson, Brooklyn Center; Jack T. Mowry, Ramsey, both of Minn.

[73] Assignee: Neos, Inc., Elk River, Minn.

[21] Appl. No.: 08/882,422

[22] Filed: Jun. 25, 1997

[51] Int. Cl.[6] ..... B65G 47/84

[52] U.S. Cl. ..... 414/797.4; 198/468.11; 198/745

[58] Field of Search ..... 198/468.11, 719, 198/745, 346.2; 414/797.4, 788.2

[56] References Cited

U.S. PATENT DOCUMENTS 3,530,975 9/1970 Thumin et al. ..... 198/719
4,119,215 10/1978 Dopp ..... 198/468.11
4,533,039 8/1985 Grims ..... 198/719
4,767,252 8/1988 Pignal et al. ..... 198/346.2
5,320,212 6/1994 McIntosh et al. ..... 198/468.11

*Primary Examiner*—David A. Buccl
*Assistant Examiner*—Gregory A. Morse
*Attorney, Agent, or Firm*—Nawrocki, Rooney & Sivertson, P.A.

[57] ABSTRACT

Self clearing transfer arms for pushing a container in an assembly process to a stage assembly wherein the pushing arms are retractable to a position out of obstruction relationship to the stage assembly. The pushing arms each have a transfer arm, a gate and a hinge. The hinge rotatably attaches the transfer arm to the gate in an orientation providing for rotation of the gate out of an obstruction relation to the stage assembly if unintended contact with the stage assembly or the container occurs.

11 Claims, 5 Drawing Sheets

SELF-CLEARING TRANSFER ARMS

BACKGROUND OF THE INVENTION

1. Field of the Invention

The present invention relates to transfer arms to hold and move a container to a stage assembly, and more particularly, to such transfer arms having a self-clearing capability if unintended contact with the stage assembly or container occurs.

2. Description of the Prior Art

The prior art is replete with a variety of machines using various transfer mechanisms to move product through an assembly or manufacturing process. Empty containers supplied to the machine may undergo a variety of steps involving filling the container with product and the subsequent sealing and labeling steps. Following each step, the container may be discharged while a new container is moved into position to undergo the same step and repeat the cycle. Such machines are subject to stress and wear as they typically operate at high speeds. Often times malfunctions may occur which result in a shut-down of the machine, thus, reducing the effective rate at which product may be moved through an assembly or manufacturing process.

In typical prior art machines, empty containers may be positioned on and moved along a slide or track assembly by a transfer mechanism. The transfer mechanism may have a form adapted to receive the product and sufficient to retain the container during positioning. The transfer mechanism may move the empty container to a stage assembly to be filled with product. The stage assembly may lift the empty container to a product dispensing source to fill the container with product. The transfer mechanism may next move the filled container off of the stage assembly while at the some time moving the next empty container to be filled onto the stage assembly. The filled container moved off of the stage assembly may be positioned onto a conveyor slide for movement to the next step in the assembly process.

Unfortunately, typical prior art machines have many disadvantages. First, often times machines may be moving product through an assembly operation at a high rate of speed thus requiring a high degree of coordination between all moving elements of the assembly process. These moving elements may have an interaction which requires one moving element, such the transfer mechanism, to clear a position once delivering a container, before another moving element, such as the stage assembly, moves the container to a subsequent stage. If this coordination of moving elements is not perfect, the assembly operation may have to operate at a slower rate to avoid accidents. If an accident such as one moving element contacting another does occur, the assembly operation may have to be shut down to make necessary repairs. In either case the rate of assembly operation is not optimized.

Another disadvantage is that the containers may become stuck in the transfer mechanism resulting in a shut-down of the assembly process. This shutdown may be necessary to allow the container may be removed. The containers may become stuck as a result of ineffectively adapting different sized containers to the same assembly process. In addition, manufacturing tolerances may vary from one container to another, resulting in some containers being oversized and becoming stuck within the transfer mechanism. The containers may also leak or spill product, resulting in the container being stuck in an assembly mechanism. In either case the transfer mechanism may need to be shut down to allow the container to be removed.

SUMMARY OF THE INVENTION

The present invention overcomes the disadvantages found in the prior art by providing self clearing transfer arms for pushing a container in an assembly process to a stage assembly wherein the pushing arms are retractable to a position out of obstruction relationship to the stage assembly. The pushing arms each have a transfer arm, a gate and a hinge. The hinge rotatably attaches the transfer arm to the gate in an orientation providing for rotation of the gate out of an obstruction relation to the stage assembly if contact with the stage assembly or the container occurs.

In a preferred embodiment, the self-clearing transfer arms are provided in the environment of a transfer station. The transfer station includes a transfer mechanism, a stage assembly, and a conveyor assembly. The transfer mechanism has a right transfer arm and a left transfer arm. The right and left transfer arms are spaced a distance apart to receive a container from a plurality of empty containers. The container is a bucket, which is generally cylindrical in shape, which has a closed bottom end, an open top end, and a mid-region between the closed bottom end and the open top end. The plurality of empty containers, including the container, have a common cylindrical axis. The right transfer arm and the left transfer arm each have a pusher which is comprised of a shaft and a disk. The shaft is perpendicular to and in radial alignment with the common cylindrical axis. Each disk is positioned such that the axis of the shaft perpendicularly intersects a center of a contact surface of the disk such that the plane of the contact surface of the disk is tangential to an outer surface of the container at the mid-region. An actuator mount is attached to both the right transfer arm and the left transfer arm to rigidly attach the right and left transfer arms to a mechanical means to move the container. The right transfer arm and the left transfer arm each have a gate which is hingably attached to the transfer arm. Each gate further has a first portion, a second portion, and a bend portion disposed therebetween.

In the preferred embodiment, the right transfer arm and the left transfer arm receive the container and move the container from a first position where the empty container is received to a second position on the stage assembly. The right transfer arm and left transfer arm each provide contact points at the contact surface of the disk and at a distal end of the gate. The bend portions of the gates of the right transfer arm and the left transfer arm reduce the distance between distal ends of the gates to a distance less than that of the diameter of container. When the container is received by the right transfer arm and the left transfer arm, a right slide and a left slide slidably engage the closed bottom end of the container to allow the transfer mechanism to slidably move the container from the first position to the second position. Once in the second position, the container is centered upon a stage of the stage assembly. A ram may then lift a bowl which supports the stage to a third position since the bowl is rigidly attached to the ram. The stage is a cylindrical platter which is slidably mounted inside the bowl. In the third position, the stage is seated within the bowl, and a fence portion of the bowl has an upper lip which extends above an upper surface of the stage to provide means to hold the container in a centered position upon the stage. The stage further has a plurality of legs which are each aligned with and extend through a plurality of leg holes within the bowl. The legs contact a top surface of an annular landing when the stage is in the second position to position the stage above the fence portion of the bowl. Once the stage assembly is in the third position, the transfer mechanism is moved back to the first position out of a path of obstruction relationship to the stage assembly.

In the preferred embodiment, once in the third position, the container may be filled with product flowing through a dispenser fill tube. The container is filled with product while being lowered by the stage assembly from the third position to the second position. The transfer mechanism, which is in the first position, may then receive a new container from the plurality of empty containers. The transfer mechanism may then transport the empty container from the first position to the second position. When moving the empty container into the second position, the distal end of gates of the right transfer arm and the left transfer arms may contact the product filled container currently in the second position and move the product filled container to the fourth position on the conveyor slide of conveyor assembly. In an alternative embodiment the empty container may provide means to contact the product filled container to move the product filled container to the fourth position. Displacing or sliding the product filled container onto a conveyor belt to the fourth position allows the new empty container to be positioned on the stage. The conveyor belt then moves the product filled container to a next step in the assembly process. A conveyor end roller is positioned in close proximity to the upper surface of the stage when the stage assembly is in the second position so that the conveyor belt is at the same height as the upper surface of the stage to allow the product filled container to be easily moved onto the conveyor belt.

In the preferred embodiment, while the bowl of the stage assembly is being moved from the second position to the third position, the bowl may contact the gate of either or both of the right or left transfer arms if the transfer arms are being retracted from the second position to the first position since the bowl of the stage has a diameter which is greater than the distance between the distal ends of the gates of the transfer arms. Contact occurs if the distance between the distal end of the gate of the right transfer arm and the distal end of the gate of the left transfer arm is less than a cross-section of the bowl measured between the distal ends of the gate for the particular position of the right and left transfer arm between the first and second position. Once contact is made, the gates of the right and the left transfer arms may rotate out of an obstruction relation to the stage assembly as each gate is hingably attached to the transfer arm. Prior to rotation, each gate is in a first position. Each gate may be rotated to a respective second position when contact with the stage assembly or container occurs, and since each gate has a center of gravity which allows a self-initiating return to the first position, once the stage assembly or the container move out of an obstruction relationship, each gate returns to the first position. In the preferred embodiment angle $\phi$ is the angle between an axis of the first portion of the gate and an axis of the transfer arm measured in a plane perpendicular to the axis of rotation of the hinge where angle $\phi$ is always equal to or less than 180°. The first position is defined by the axis of the first portion being aligned with the axis of the transfer arm when angle $\phi$ equals 180°. The second position is defined by angle $\phi$ being approximately equal to 90°. The contact between the transfer arm and the stage assembly or container results in the gate rotating from an angle $\phi$ of 180° to an angle $\phi$ greater than 90° out of obstruction relation to the stage assembly, and self-initiating a return back to an angle $\phi$ of 180° once the obstruction has cleared.

In the preferred embodiment, a hinge provides means to rotatably attach the transfer arm to the gate, wherein each hinge has a plurality of lands, a hinge pin and an ear. The hinge pin is fixed in a hinge hole and is in alignment with an axis of the hinge hole. The plurality of lands positioned at a distal end of the transfer arm define a slot. The ear positioned at the proximal end of the gate is sized to be slidably received by the slot. The hinge hole extends through the plurality of lands and the ear to rotatably attach the gate to the transfer arm. A bevel is located near a proximal end of the gate which has a surface contour conforming to an adjacent surface of the container or bowl when the gate is in the second position. A surface at a proximal end of the gate may contact one or more of the plurality of lands to prevent rotation of the gate to an angle $\phi$ greater than 180°.

In the preferred embodiment an angle $\alpha$ is defined as the angle between a rotational axis of the hinge and the axis of the transfer arm. Angle $\alpha$ is defined within a plane parallel to both the rotational axis of the hinge and the axis of the transfer arm. In the preferred embodiment angle $\alpha$ is preferably between 90° and 180° so that once the gate is rotated away from the first position, the distal end of the gate may move away from an obstruction relationship to the bowl or the container.

In the preferred embodiment, the angle $\beta$ is defined between the axis of the first portion of the gate and the axis of the second portion of the gate. Angle $\beta$ is measured in a plane parallel to both the axis of the first portion of the gate and the axis of the second portion of the gate. Angle $\beta$ is preferably between a range of 90° and 180° to allow the distal end of the gate to rotate out of an obstruction relationship to the bowl or container as the gate is rotated from the first position to the second position.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the FIGS. thereof and wherein.

DETAILED DESCRIPTION OF THE PREFERRED EMBODIMENTS

Figure 1:
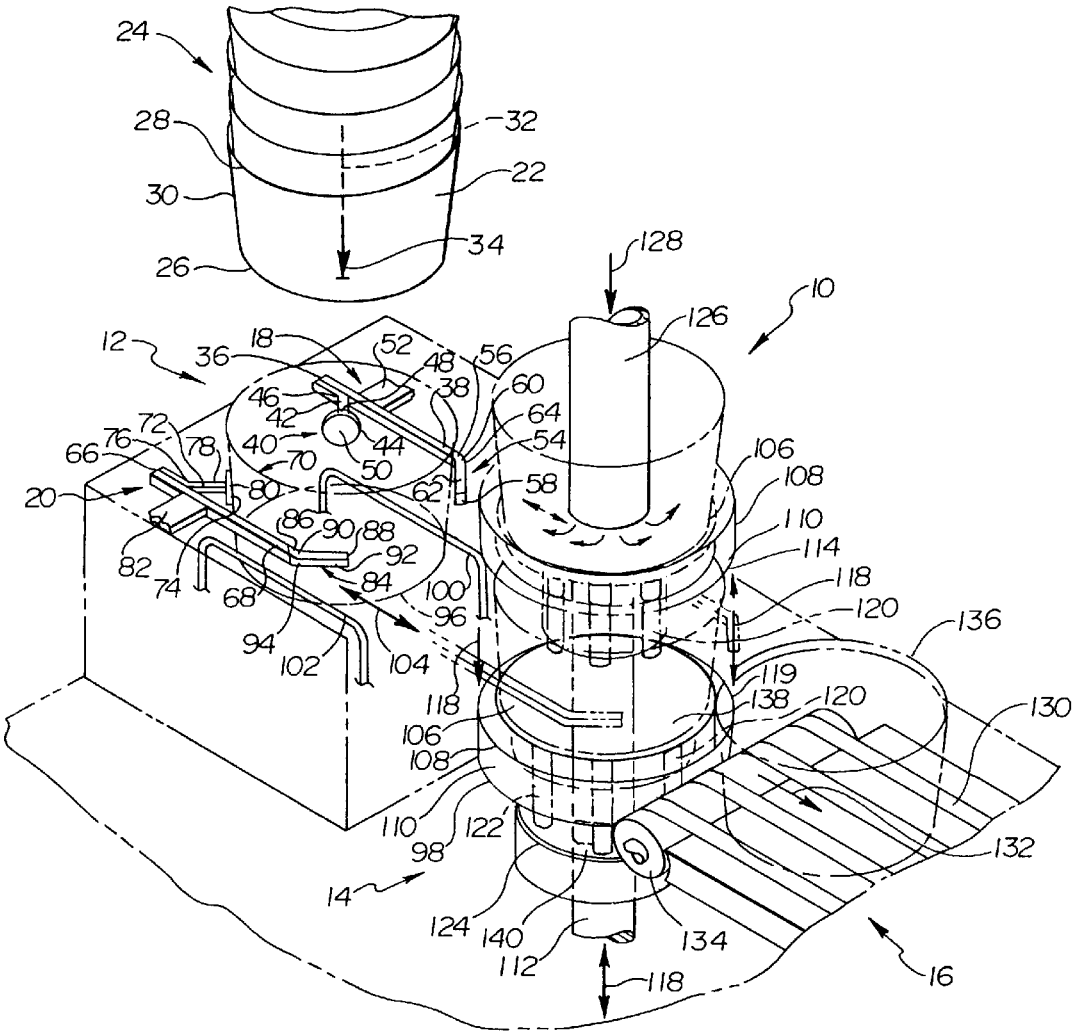
FIG. 1 is a perspective view of the invention in the environment of a transfer station and shown in motion by phantom dashed lines.

Referring now to the drawings, where like reference numerals refer to like elements throughout the several views, FIG. 1 is a perspective view of the invention in the environment of a transfer station and shown in alternate positions by phantom lines. The transfer station is shown generally at 10 and includes a transfer mechanism 12 at a receiving position, a stage assembly 14, and a conveyor assembly 16. Transfer mechanism 12 includes a pair of pushing arms which are right transfer arm 18 and a left transfer arm 20. Right transfer arm 18 and left transfer arm 20 are spaced a distance a part to receive container 22 from the plurality of rested empty containers 24. Container 22 is shown as a bucket, which is generally cylindrical in shape, which has a closed bottom end 26, an open top end 28, and a mid-region 30 between the closed bottom end 26 and the open top end 28. The plurality of empty containers, including container 22, have a common cylindrical axis 32. Arrow 34, shown axially aligned with axis 32, illustrates the direction of travel necessary to place container 22 between right transfer arm 18 and left transfer arm 20 from the plurality of empty containers 24. Right transfer arm 18 further has proximal end 36 and distal end 38. Right pusher 40 is comprised of right shaft 42 and right disk 44. Proximal end 46 of right shaft 42 is mounted near proximal end 36 of right transfer arm 18. Right shaft 42 is perpendicular to and in radial alignment with axis 32. Right disk 44 is mounted at distal end 48 of right shaft 42, and is positioned such that the axis of right shaft 42 perpendicularly intersects a center of right contact surface 50, such that the plane of right contact surface 50 is tangential to an outer surface of container 22 at mid-region 30. Right actuator mount 52 is attached to right transfer arm 18 at a position midway between proximal end 36 and distal end 38 to rigidly attach right transfer arm 18 to a mechanical means (not shown) to provide for movement of right transfer arm 18 in the direction of arrow 104. Right transfer arm 18 further includes right gate 54, which is hingably attached at a proximal end 56 to distal end 38 of right transfer arm 18. Right gate 54 has a right first portion 60, a right second portion 62, and a right bend portion 64 disposed therebetween. Left transfer arm 20 further has proximal end 66 and distal end 68. Left pusher 70 is comprised of Left shaft 72 and left disk 74. Proximal end 76 of left shaft 72 is mounted near proximal end 66 of left transfer arm 20. Left shaft 72 is perpendicular to and in radial alignment with axis 32. Left disk 74 is mounted at distal end 78 of left shaft 72, and is positioned such that the axis of left shaft 72 perpendicularly intersects a center of left contact surface 80, such that the plane of left contact surface 80 is tangential to an outer surface of container 22 at mid-region 30. Left actuator mount 82 is attached to left transfer arm 20 at a position midway between proximal end 66 and distal end 68 to rigidly attach left transfer arm 20 to a mechanical means (not shown) to provide for movement of left transfer arm 20 in the direction of arrow 104. Left transfer arm 20 further is comprised of left gate 84, which is hingably attached at a proximal end 86 to distal end 68 of left transfer arm 20. Left gate 84 has a left first portion 90, a left second portion 92, and a left bend portion 94 disposed therebetween.

When container 22 is moved in the direction of arrow 34 into position, as shown at 96, right transfer arm 18 and left transfer arm 20 provide means for holding container 22 in position and for moving container 22 to position, as shown at 98. Right transfer arm 18 provides contact points at right contact surface 50 and at distal end 58 of right gate 54. Left transfer arm 20 provides contact points at left contact surface 80 and distal end 88 of left gate 84. Right bend 64 and left bend 94 reduce the distance between distal end 58 and distal end 88 of right gate 54 and left gate 84, respectively, to a distance less than that of the diameter of container 22. When container 22 is in position 96, further movement in the direction of arrow 34 is prevented by right slide 100 and left slide 102. Right slide 100 and left slide 102 slidably engage closed bottom end 26 of container 22 to allow the transfer mechanism 12 to slidably move container 22 from position 96 to position 98 in the direction of arrow 104. Once in position 98, container 22 may be centered upon stage 106 of stage assembly 14. Ram 112 then may lift bowl 110 in the direction of arrow 118 to an elevated position as shown at 114 since bowl 110 is rigidly attached to ram 112. Stage 106 is a cylindrical platter which is slidably mounted inside bowl 110. In position 114, stage 106 is seated within bowl 110, and fence 108 has an upper lip 119 which extends above upper surface 138 of stage 106 to provide means to hold container 22 in a centered position upon stage 106. Stage 106 further has legs 120 which are aligned with and extend through leg holes 122. Legs 120 contact top surface 140 of annular landing 124 when stage 106 is in position 98. Once stage assembly 14 is in position 114, transfer mechanism 12 is moved back to position 96 out of a path of obstruction relationship to bowl 110 of stage assembly 14. Bowl 110 has a diameter which is greater than the distance between distal end 58 of right gate 54 and distal end 88 of left gate 84. If transfer mechanism 12 is moved from position 98 to position 96 at the same time as bowl 110 is lifted from position 98 to position 114, it is possible that bowl 110 may contact right gate 54 or left gate 84.

Once in position 114, container 22 may be filled with product flowing in the direction of arrow 128 through dispenser fill tube 126. Container 22 is filled with product while being lowered in the direction of arrow 118 from upper position 114 to lower position 98. Transfer mechanism 12, which is in position 96, may then receive a new container from the plurality of rested empty containers 24. Transfer mechanism 12 may then transport the empty container in the direction of arrow 104 to position 98. When the empty container is moved into position 98 by disks 44 and 74, distal end 58 of right gate 54 and distal end 88 of left gate 84 engages the product-filled container currently in position 98 to move the product-filled container to position 136 on conveyor slide 130 of conveyor assembly 16. Optionally the empty container may be brought into engagement with the product-filled container to move the product-filled container to position 136. Displacing or sliding the product filled container onto conveyor belt 130 into position 136 allows the empty container to be positioned on stage 106 in position 98. Conveyor belt 130 moves in the direction of conveyor motion 132 to move the product filled container to a next step in the assembly process. Conveyor end roller 134 is positioned in close proximity to upper surface 138 of stage 106 when stage assembly 14 is in position 98 so that conveyor belt 130 is at the same height as upper surface 138 of stage 106 to allow the product filled container to be easily moved onto conveyor belt 130.

Figure 2:
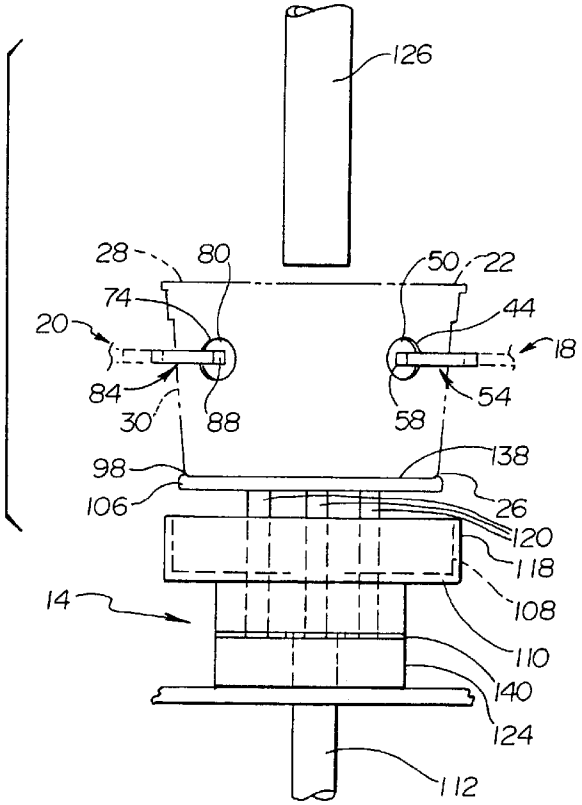
FIG. 2 is a fragmentary front elevational view thereof.

FIG. 2 is a fragmentary front elevational view showing stage 106 in position 98. The stage assembly is shown generally at 14. As container 22 is moved from position 96 to position 98, right transfer arm 18 and left transfer arm 20 hold container 22 in place. Right transfer arm 18 provides contact points at right contact surface 50 and at distal end 58 of right gate 54. Left transfer arm 20 provides contact points at left contact surface 80 and distal end 88 of left gate 84. The contact points at right contact surface 50 and distal end 58 of right gate 54 and at left contact surface 80 and distal end 88 of left gate 84 are positioned to approximate the circumference of container 22 at mid-region 30 to hold container 22 in position 98. Stage 106 has legs 120 which are slidably mounted inside bowl 110. In position 98, legs 120 contact top surface 140 of an annular landing 124 to position stage 106 such that top surface 138 of stage 106 is at the same height as slide 100 and slide 102 so that stage 106 may slidably receive container 22 when right transfer arm 18 and left transfer arm 20 move container 22 from position 96 to position 98.

Figure 3:
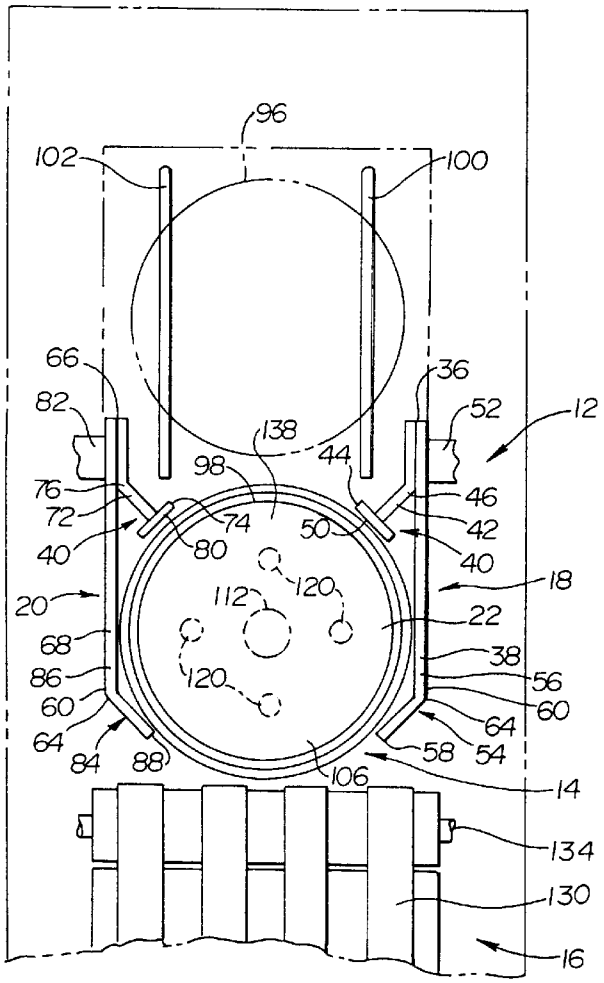
FIG. 3 is a top plan view thereof with parts advanced.

FIG. 3 is a top plan view showing right transfer arm 18 and left transfer arm 20 advanced to position 98. FIG. 3 shows right transfer arm 18 and left transfer arm 20 holding container 22 in position 98 via a plurality of contact points. Right transfer arm 18 provides contact points at right contact surface 50 and at distal end 58 of right gate 54. Left transfer arm 20 provides contact points at left contact surface 80 and distal end 88 of left gate 84. These contact points are located approximately at the circumference of container 22 at mid-region 30 to hold container 22 in position 98 by contacting the surface of container 22 at mid-region 30. Legs 120 are attached to stage 106 and support stage 106 by contact top surface 140 of annular landing 124.

Figure 4:
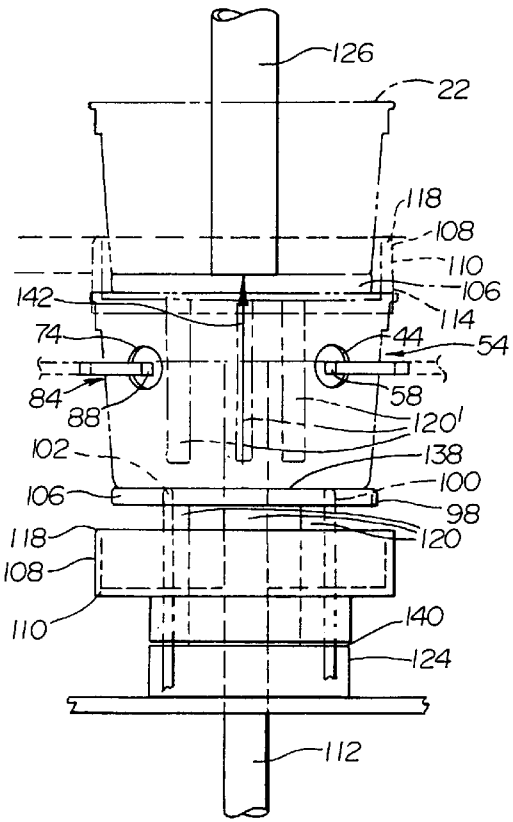
FIG. 4 is a fragmentary front elevational view thereof with parts advanced.

FIG. 4 is a fragmentary front elevational view showing container 22 being moved from position 98 to position 114. The direction of motion is shown by arrow 142. As ram 112 lifts bowl 110 in the direction shown by arrow 142, stage 106 has legs 120 which are slidably mounted through leg holes 122 of bowl 110 to provide for stage 106 to become seated in the bottom of bowl 110 once bowl 110 rises to a height equivalent to that of legs 120. Bowl 110 rises to a height equivalent to that of legs 120 when moved in the direction of arrow 124 at a position between position 98 and position 114. When stage 106 is seated within bowl 110, fence 108 has an upper lip 119 which extends above upper surface 138 of stage 106 by a distance d1 to hold container 22 in a centered position upon stage 106. Once stage 106 is seated within bowl 110, legs 120 no longer contact top surface 140 of annular landing 124 as bowl 110 is moved to position 114 in the direction of arrow 142.

Figure 5:
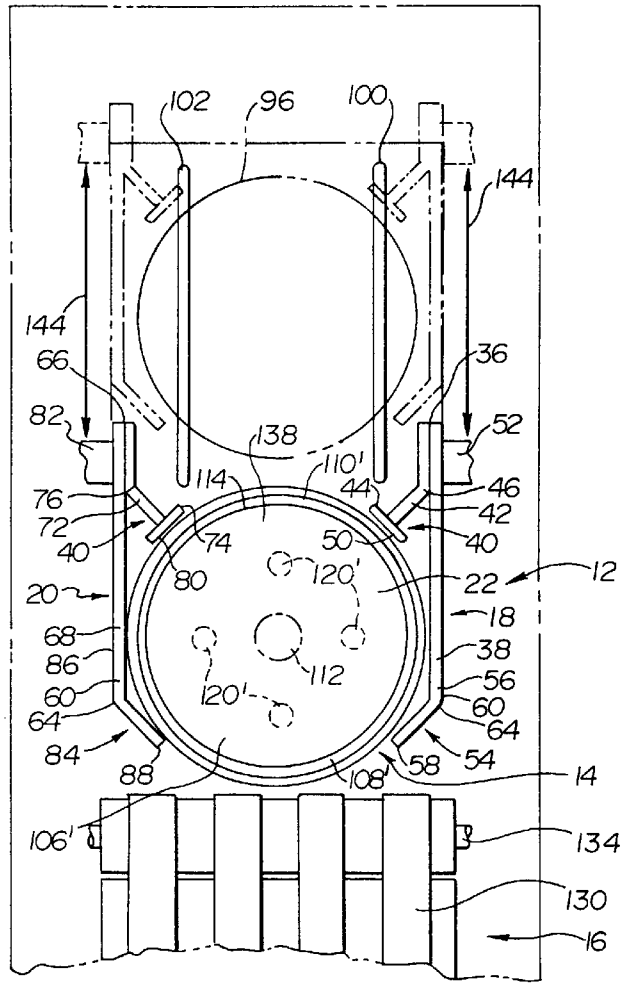
FIG. 5 is a top plan view thereof with parts advanced and retracted.

FIG. 5 is a top plan view showing stage 106, fence 108 and bowl 110 in position 114. Transfer mechanism 12 moves container 22 in the direction shown by arrow 144 from position 96 to position 98. The movement from position 98 to position 114 of stage assembly 14 is in the direction of arrow 142, which is perpendicular to the plane of FIG. 5. Thus FIG. 5 shows the top view when stage assembly 14 is in position 114 which is similar to the top view shown in FIG. 3 when stage assembly 14 is in position 98. Once stage 106 maintains container 22 in position 114, transfer mechanism 12 may retract in the direction of arrow 144 from position 98 to position 96 to receive a new container. Transfer mechanism 12 is moved from position 98 to position 96 while container 22 is held by stage 106 in position 114 so that distal end 58 of right gate 54 and distal end 88 of left gate 84 do not contact bowl 110. This is because the diameter of bowl 110 is greater than the distance between distal end 58 of right gate 54 and distal end 88 of left gate 84. Once transfer mechanism 12 is in position 96, stage 106 and bowl 110 may be moved by ram 112 from position 114 to position 98.

Figure 6:
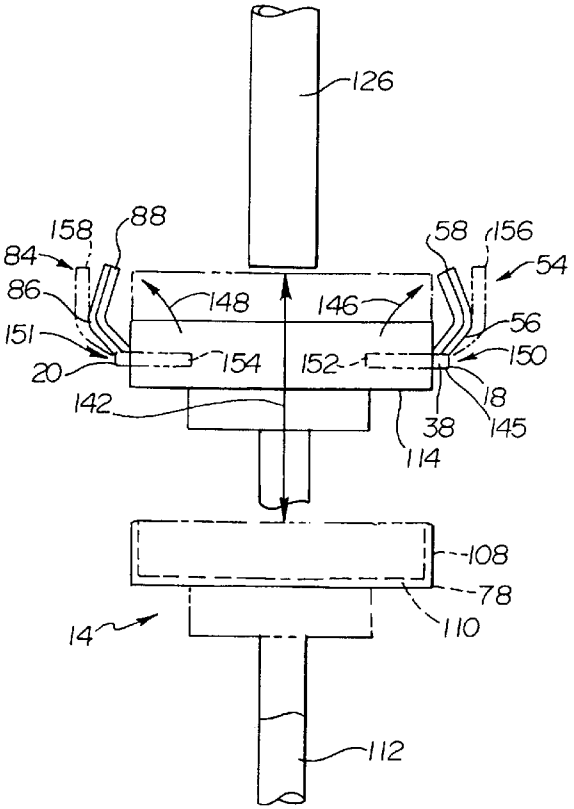
FIG. 6 is a fragmentary front elevational view thereof with parts elevating and advancing.

FIG. 6 is a fragmentary front elevational view showing bowl 110 at stage assembly 14 being moved from position 98 toward position 114 and being engaged by right gate 54 and left gate 84 when stage assembly 14 is in position 145. Position 145 is between position 98 and position 114. Since the distance between distal end 58 of right gate 54 and distal end 88 of left gate 84 is less than the diameter of bowl 110, when stage assembly 14 is in position 145, bowl 110 may be engaged by distal end 58 of right gate 54 and distal end 88 of left gate 84. Once contact is made, right gate 54 may swivel in the direction shown by arrow 146 and left gate 84 may swivel in the direction shown by arrow 148. Proximal end 56 of right gate 54 is hingably attached to distal end 38 of right transfer arm 18 via hinge 150 to provide for rotation of right gate 54 in the direction of arrow 146. Proximal end 86 of left gate 84 is hingably attached to distal end 68 of left transfer arm 20 via hinge 151 to provide for rotation of left gate 84 in the direction of arrow 148. Prior to rotation, right gate 54 and left gate 84 are in first position 152 and first position 154 respectively. Right gate 54 and left gate 84 may be rotated in the direction respectively shown by arrows 146 and 148 as far as second positions 156 and 158, respectively. Right gate 54 and left gate 84, when in second position 156 and second position 158, respectively, each have a center of gravity which allows a self-initiating return to first position 152 and first position 154 once bowl 110 is moved away from an obstruction relationship to right gate 54 and left gate 84. Bowl 110 is not in an obstruction relationship with right gate 54 and left gate 84 when in position 98 or position 114.

Figure 7:
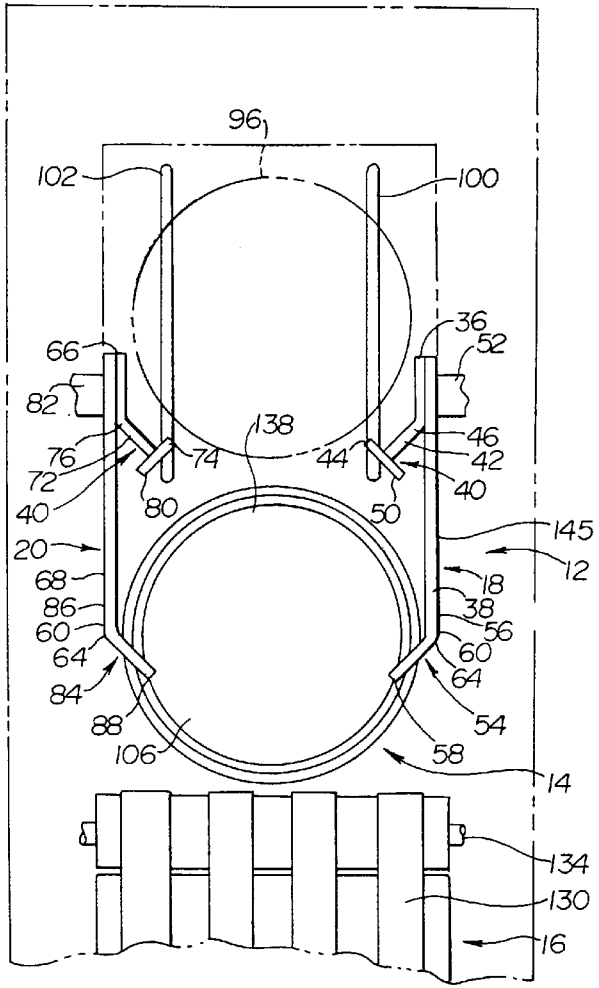
FIG. 7 is a top plan view thereof.

FIG. 7 is a top plan view showing bowl 110 of stage assembly 14 in an obstruction relationship with right gate 54 and left gate 84 when bowl 110 is in position 144 and right gate 54 and left gate 84 are in position 98. FIG. 7 illustrates that right gate 54 and left gate 84 are not in an obstruction relationship to bowl 110 when transfer mechanism 12 is in position 96. Right gate 54 and left gate 84 are also not in an obstruction relationship to bowl 110 when positioned anywhere along the length of travel in the direction of arrow 144 when the distance between distal end 58 of right gate 54 and distal end 88 of left gate 84, when in position 152 and 154 respectively, is greater than the width of bowl 110 at a particular position of transfer mechanism 12 within the range of travel defined by arrow 144.

Figure 8:
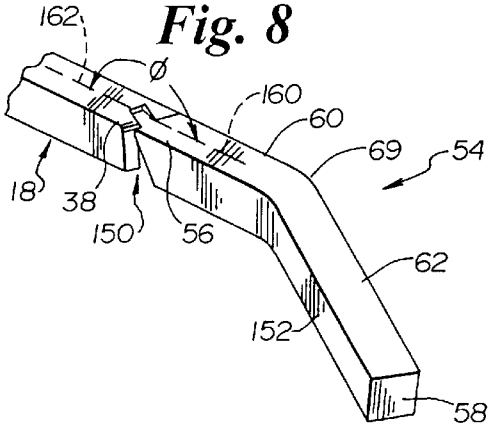
FIG. 8 is a fragmentary perspective view thereof shown slightly enlarged from the prior figures.

FIG. 8 is a fragmentary perspective view showing right gate 54 in first position 152. Right first portion 60 has a corresponding axis 160. Right transfer arm 18 has an axis 162. Angle $\phi$ is the angle between axis 160 of right first portion 60 and axis 162 of right transfer arm 18 measured in a plane perpendicular to axis 164 of hinge 150 such that angle $\phi$ is always equal to or less than 180° (see FIG. 9). First position 152 is defined by axis 160 being aligned with axis 162 when angle $\phi$ equals 180°. Hinge 150 provides means to rotatably attach right transfer arm 18 to right gate 54.

Figure 9:
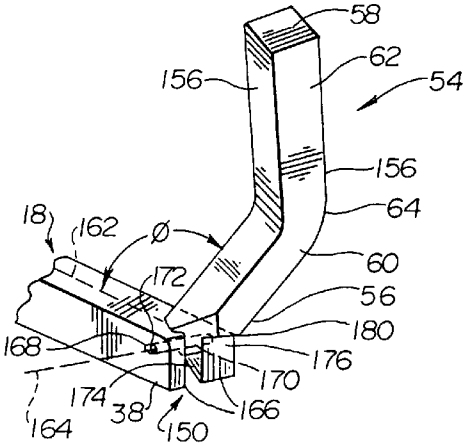
FIG. 9 is a fragmentary perspective view thereof shown slightly enlarged from the prior figures.

FIG. 9 shows right gate 54 in second position 156. Second position 156 is defined by angle $\phi$ being approximately equal to 90°. Hinge 150 is defined by lands 166, hinge pin 168 and ear 170. Hinge pin 168 is fixed in hinge hole 172 and is in alignment with axis 164. Lands 166 define slot 174. Ear 170 is sized to be slidably received by slot 174. Hinge hole 172 extends through lands 166 and ear 170 to rotatably attach right gate 54 to right transfer arm 18. Bevel 176 is located near proximal end 56 of right gate 54 and has a surface contour conforming to an adjacent surface of container 22 or bowl 110 when right gate 54 is in position 156. Surface 180 of right gate 54 contacts one or more of lands 166 to prevent rotation of right gate 54 to an angle $\phi$ greater than 180° (see also, FIG. 14).

Figure 10:
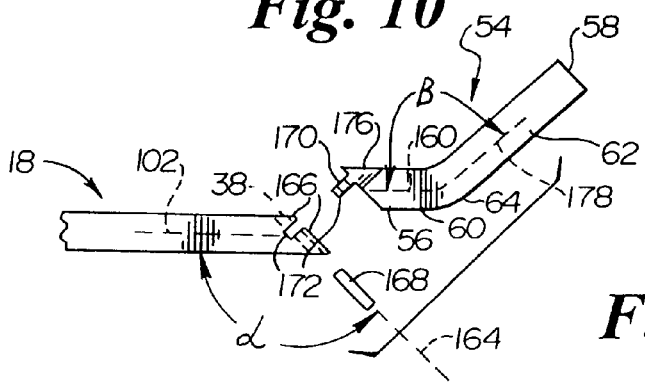
FIG. 10 is a fragmentary bottom plan exploded view thereof.

FIG. 10 is a fragmentary bottom plan exploded view of right gate 54 and distal end 38 of right transfer arm 18. FIG. 10 shows hinge pin 168 in alignment with axis 164 and bore 172. Bore 172 extends through lands 166 and ear 170 such that right gate 54 may be hingably attached to right transfer arm 18. Angle $\alpha$ is defined as the angle between axis 164 of bore 172 and axis 162 of right transfer arm 18. Angle $\alpha$ is defined within a plane parallel to both axis 162 and axis 164. Angle α is preferably between 90° and 180° so that as right gate 54 is rotated from first position 152 in the direction defined by arrow 146, distal end 58 of right gate 54 moves away from an obstruction relationship to bowl 110. End portion 64 is defined by angle β between axis 160 of right first portion 60 and an axis 178 of right second portion 62. Angle β is defined in a plane parallel to both axis 160 and axis 178. Angle β is preferably between a range of 90° and 180° to allow distal end 58 of right gate 54 to rotate out of an obstruction relationship to bowl 110 as right gate 54 is rotated from a first position 152 in the direction of arrow 146 toward a second position 156.

Figure 11:
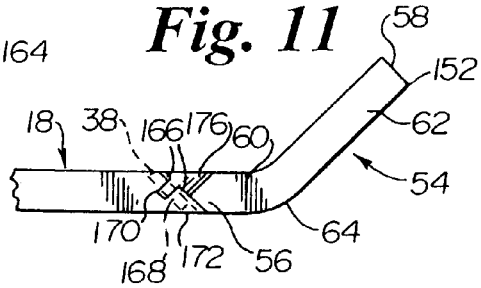
FIG. 11 is a fragmentary bottom plan view thereof.

FIG. 11 is a fragmentary bottom plan view showing right gate 54 in first position 152 hingably attached to distal end 38 of right transfer arm 18. FIG. 11 shows hinge pin 168 fixably inserted within lands 166 and slidably inserted through ear 170 to provide for rotation of right gate 54 between first position 152 and second position 156.

Figure 12:
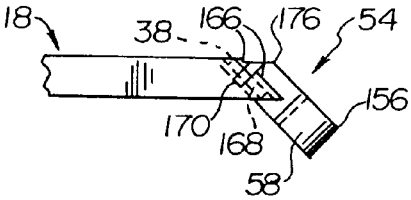
FIG. 12 is a fragmentary bottom plan view thereof.

FIG. 12 is a fragmentary bottom plan view showing right gate 54 in position 156. FIG. 12 shows bevel 176 having a surface contour optimally designed to maximize clearance to bowl 110 when right gate 54 is in position 156. The surface contour of bevel 176 may approximate an adjacent surface on an outer circumference of container 22 or bowl 110 to provide for maximum clearance for container 22 or bowl 110 when right gate 54 is in position 156.

Figure 13:
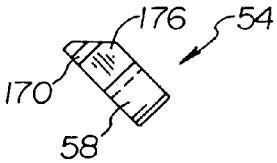
FIG. 13 is a detail bottom plan view of part thereof.

FIG. 13 is a detailed bottom plan view of right gate 54. FIG. 13 shows bevel 176 when right gate 54 is in position 156.

Figure 14:
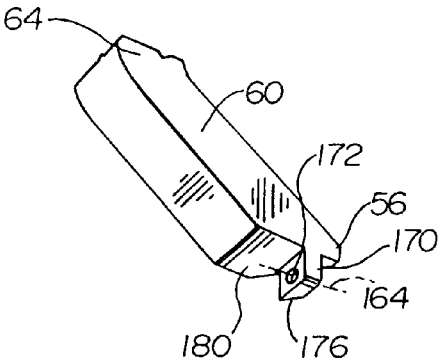
FIG. 14 is a fragmentary detail perspective view thereof.

FIG. 14 shows right first portion 60 of right gate 54. FIG. 14 shows bevel 176 extending to a portion of ear 170 to provide maximum clearance for container 22 or bowl 110 when gate 54 is in position 156. Surface 180 of right gate 54 contacts one or more of lands 166 to prevent rotation of right gate 54 to an angle ϕ greater than 180°.

Having thus described the preferred embodiments of the present invention, those of skill in the art will readily appreciate that the teachings found herein may be applied to yet other embodiments within the scope of the claims hereto attached.

What is claimed is:

1. Apparatus for sequentially urging a container from a receiving position to a transfer position, having a board lift, of a transfer station, and, concurrently, another container from the transfer position to a conveyor position of the transfer station, comprising:

a. a first transfer arm, reciprocally movable along an axis, said first transfer arm having a first pusher to engage a container in the receiving position and to urge the container in the receiving position into the transfer position;

b. a first gate, mounted to said transfer arm at a location, spaced from said first pusher in a direction of intended movement through the transfer station, to engage a container in the transfer position and to urge the container in the transfer position into the conveyor position; and c. means for retracting said first gate in response to engagement of said first gate by the bowl lift.

2. Apparatus in accordance with claim 1 wherein said means for retracting comprises means for rotatably attaching said gate to said transfer arm.

3. Apparatus according to claim 2 wherein the gate has a bend portion disposed between first and second ends thereof, a first portion defined between the first end and said bend portion having a first axis, a second portion defined between said bend portion and the second end having a second axis, an angle β being defined between said first axis and said second axis.

4. Anparatus according to claim 3 where the angle β is between 90° and 180°.

5. Apparatus according to claim 4 wherein the first position is defined by the first axis of the first portion being axially aligned with the axis of the transfer arm, an angle ϕ being the angle between the first axis of the first portion and the axis of the transfer arm, said angle ϕ being measured in a plane perpendicular to the axis of rotation of the hinge, the first position being defined by said angle ϕ being 180°, said angle ϕ being less than 180° when the gate is not in the first position.

6. Apparatus according to claim 5 wherein the first end of the gate comprises a surface adapted to contact an outer surface of one or more of said plurality of lands to prevent rotation of the gate to an angle ϕ greater than 180°.

7. Apparatus according to claim 2 wherein the means for rotatably attaching comprises:

a. a plurality of lands attached to a second end of the transfer arm, said plurality of lands defining one or more slots;

b. a hinge pin fixed in said plurality of lands;

c. one or more ears attached at the first end of said gate, each particular one of the one or more ears in alignment with, and extending into, a particular one of the one or more slots, each particular one of the one or more ears having a bore aligned with said hinge pin to slidably receive said hinge pin, said hinge pin extending through said one or more slots to rotatably connect the transfer arm and the gate.

8. Apparatus according to claim 7 wherein the hinge pin being fixed in the plurality of lands defines an angle α between the axis of the hinge pin and the axis of the transfer arm, angle α being between 90° and 180°.

9. Apparatus according to claim 8 wherein the angle α is defined in a plane parallel to both the axis of the hinge pin and the axis of the transfer arm.

10. Apparatus according to claim 2 wherein the first pusher is attached to the transfer arm on an inner surface of the transfer arm near its first end.

11. Apparatus according to claim 2 wherein the second end of the gate is adapted to push a second container when the gate is in the first position.

* * * * *